US008128133B2

(12) United States Patent
Biancamano

(10) Patent No.: US 8,128,133 B2
(45) Date of Patent: Mar. 6, 2012

(54) METHOD AND APPARATUS FOR TYING NECKTIE KNOT

(76) Inventor: Francesco Biancamano, Huntington Station, NY (US)

( * ) Notice: Subject to any disclaimer, the term of this patent is extended or adjusted under 35 U.S.C. 154(b) by 25 days.

(21) Appl. No.: 12/766,405

(22) Filed: Apr. 23, 2010

(65) Prior Publication Data

US 2010/0327580 A1 Dec. 30, 2010

Related U.S. Application Data

(60) Provisional application No. 61/220,607, filed on Jun. 26, 2009.

(51) Int. Cl.
*D03J 3/00* (2006.01)

(52) U.S. Cl. ..... 289/17

(58) Field of Classification Search ..... 289/17, 289/18.1; 2/137, 145; 223/83, 84
See application file for complete search history.

(56) References Cited

U.S. PATENT DOCUMENTS

| | | | | | |
|---|---|---|---|---|---|
| 1,367,461 | A * | 2/1921 | Caumont | 2/153 |
| 2,271,067 | A * | 1/1942 | Fruns | 2/153 |
| 2,671,900 | A * | 3/1954 | Schreter | 2/145 |
| 3,755,821 | A * | 9/1973 | Tellone | 2/153 |
| 3,964,105 | A * | 6/1976 | Gideon | 24/49.1 |
| 4,337,539 | A * | 7/1982 | Najarian | 2/153 |
| 5,416,926 | A * | 5/1995 | Koy | 2/153 |
| 5,692,241 | A * | 12/1997 | Helfer | 2/152.1 |
| 6,120,068 | A * | 9/2000 | DiPietro | 289/17 |
| 6,149,207 | A * | 11/2000 | Bradford, Jr. | 289/18.1 |
| 6,412,673 | B1 * | 7/2002 | Chuang | 223/82 |
| 7,143,482 | B2 * | 12/2006 | Sens-Grosholz et al. | 24/66.3 |
| 7,585,004 | B1 * | 9/2009 | Page | 289/17 |
| D614,833 | S * | 5/2010 | Truong | D2/641 |
| 2008/0099035 | A1 * | 5/2008 | Ellegard | 132/275 |
| 2008/0314939 | A1 * | 12/2008 | Truong | 223/83 |

* cited by examiner

*Primary Examiner* — Shaun R Hurley
(74) *Attorney, Agent, or Firm* — The Farrell Law Firm, P.C.

(57) ABSTRACT

A method and apparatus for tying a necktie knot are provided. The apparatus includes a substantially triangular base having a front face, a back face, three edges and three corners. The apparatus also includes an integrated clip extending from an area of the back face of the substantially triangular base that is proximate to one of the three edges and between two of the three corners. The integrated clip has a flexibility that enables reception of at least one end of a necktie between the integrated clip and the substantially triangular base, and a rigidity that enables retention of the at least one end between the integrated clip and the substantially triangular base. The substantially triangular base maintains a substantially triangular structure of a necktie knot that is tied around and encases the substantially triangular base and the integrated clip.

12 Claims, 7 Drawing Sheets

METHOD AND APPARATUS FOR TYING NECKTIE KNOT

PRIORITY

This application claims priority under 35 U.S.C. §119(e) to a U.S. provisional application filed on Jun. 26, 2009, and assigned Ser. No. 61/220,607, the contents of which are incorporated herein by reference.

BACKGROUND OF THE INVENTION

1. Field of the Invention

The present invention relates to the tying of necktie knots, and more particularly, to a method and apparatus for assisting in the creation of a structurally improved necktie knot.

2. Description of the Related Art

Neckties are typically worn around the neck, resting under a shirt collar and knotted at the throat. Neckties may be worn as a part of regular office attire, semi-formal wear or formal wear.

The shape and size of a necktie knot is determined, in part, by the type of knot that is tied. The most popular knot types for ties include the four-in-hand knot, the Pratt knot, the half-Windsor knot and the Windsor knot, which is also referred to as the full-Windsor knot or the double-Windsor knot. Formation of the Windsor knot involves the greatest number of steps, and is therefore commonly known as the most complex necktie knot. However, when compared with other knot-tying methods, the Windsor knot produces a fuller triangular knot.

In order to tie a Windsor knot, the tie is placed around the neck with the broad end of the tie on the right and the narrow end of the tie on the left. The broad end of the tie is crossed in front of the narrow end. The broad end is then folded behind the narrow end and pushed through the inside of the loop between the collar and the tie. The broad end is brought back down to the left, and pulled underneath the narrow end to the right. The broad end is then brought back through the loop and back again to the right side. The broad end is brought across the front of the knot from right to left, and back through the loop again, before being inserted through the front of the knot. The knot may then be tightened using the broad end and drawn up to the collar using the narrow end.

The Windsor knot has a more desirable shape that is typically more balanced than other knot formations, however, as described above, the formation of the Windsor knot involves a great number of steps and may be difficult for a beginner or casual tie wearer.

SUMMARY OF THE INVENTION

The present invention has been made to address at least the above problems and/or disadvantages and to provide at least the advantages described below. Accordingly, an aspect of the present invention provides a method and an apparatus for use in forming a necktie knot.

According to one aspect of the present invention, a necktie knot tying apparatus is provided. The apparatus includes a substantially triangular base having a front face, a back face, three edges and three corners. The apparatus also includes an integrated clip extending from an area of the back face of the substantially triangular base that is proximate to one of the three edges and between two of the three corners. The integrated clip has a flexibility that enables reception of at least one end of a necktie between the integrated clip and the substantially triangular base, and a rigidity that enables retention of the at least one end between the integrated clip and the substantially triangular base. The substantially triangular base maintains a substantially triangular structure of a necktie knot that is tied around and encases the substantially triangular base and the integrated clip.

According to another aspect of the present invention, a method of tying a necktie with a necktie tying apparatus is provided. The necktie tying apparatus is clipped to a crossed portion of two ends of the necktie between an integrated clip and a substantially triangular base of the necktie tying apparatus. The integrated clip of the necktie tying apparatus extends behind the crossed portion of the tie proximate to a shirt, and the substantially triangular base is disposed in front of the crossed portion of the necktie. The integrated clip has a flexibility that enables reception of the crossed portion of the necktie between the integrated clip and the substantially triangular base, and a rigidity that enables retention of the crossed portion of the necktie between the integrated clip and the substantially triangular base. A necktie knot is tied around the necktie tying apparatus. The substantially triangular base maintains a substantially triangular structure of the necktie knot that is tied around and encases the substantially triangular base and the integrated clip.

BRIEF DESCRIPTION OF THE DRAWINGS

Aspects, features and advantages of the present invention will become more apparent from the following detailed description when taken in conjunction with the accompanying drawings in which.

DETAILED DESCRIPTION OF EMBODIMENTS OF THE PRESENT INVENTION

Embodiments of the present invention are described in detail with reference to the accompanying drawings. Detailed descriptions of constructions or processes known in the art may be omitted to avoid obscuring the subject matter of the present invention.

Figure 1:
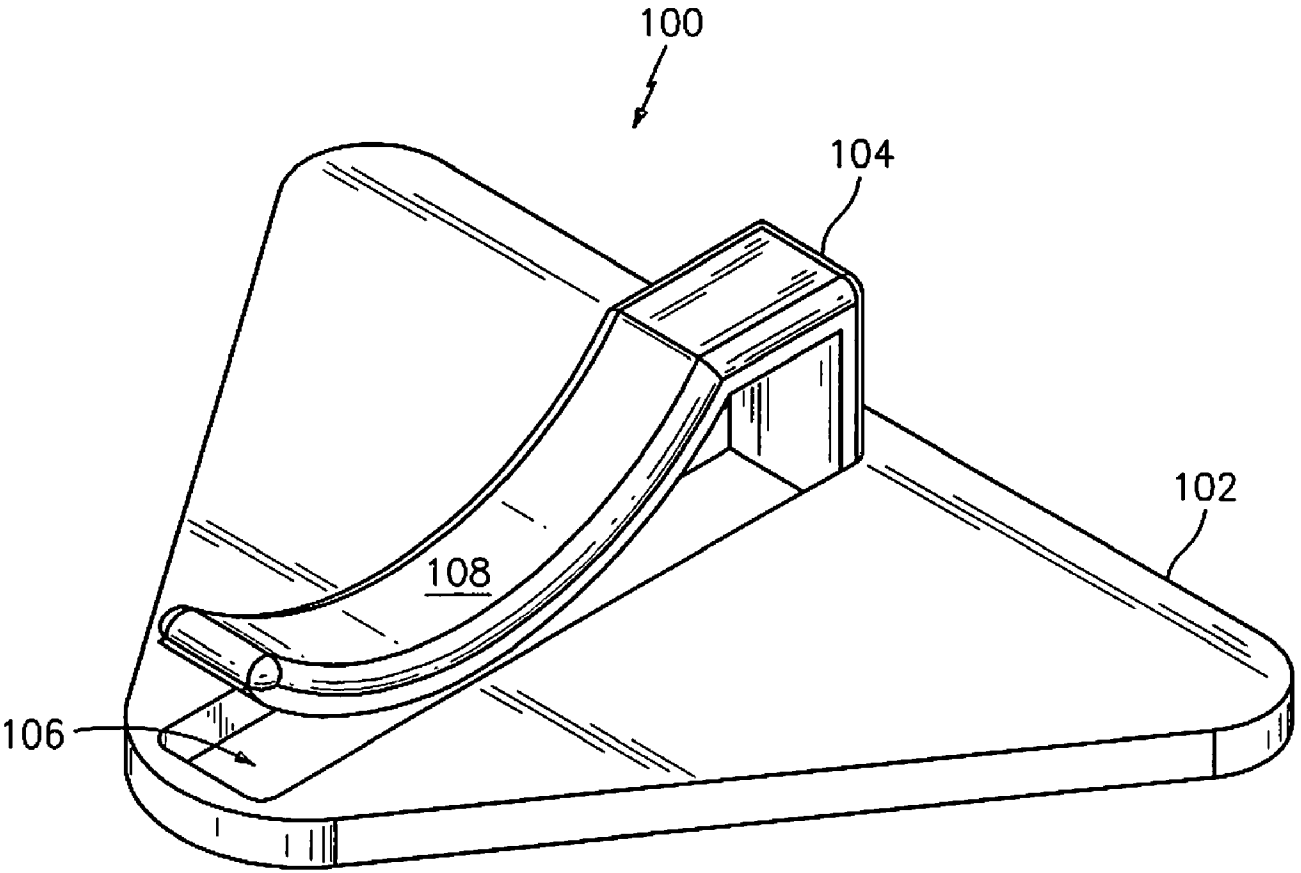
FIG. 1 is a diagram illustrating a top perspective view of a necktie knot tying apparatus, according to an embodiment of the present invention.
Figure 2:
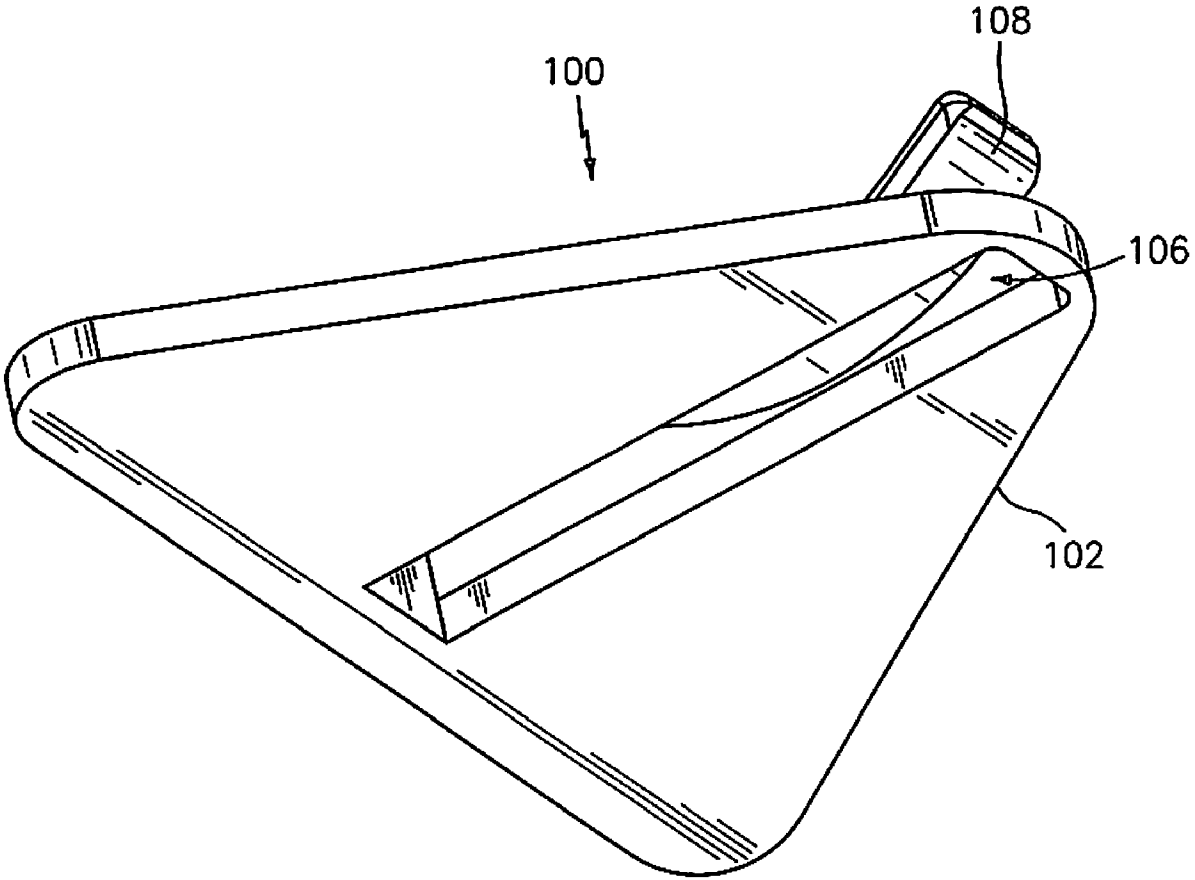
FIG. 2 is a diagram illustrating a bottom perspective view of a necktie knot tying apparatus, according to an embodiment of the present invention.
Figure 3:
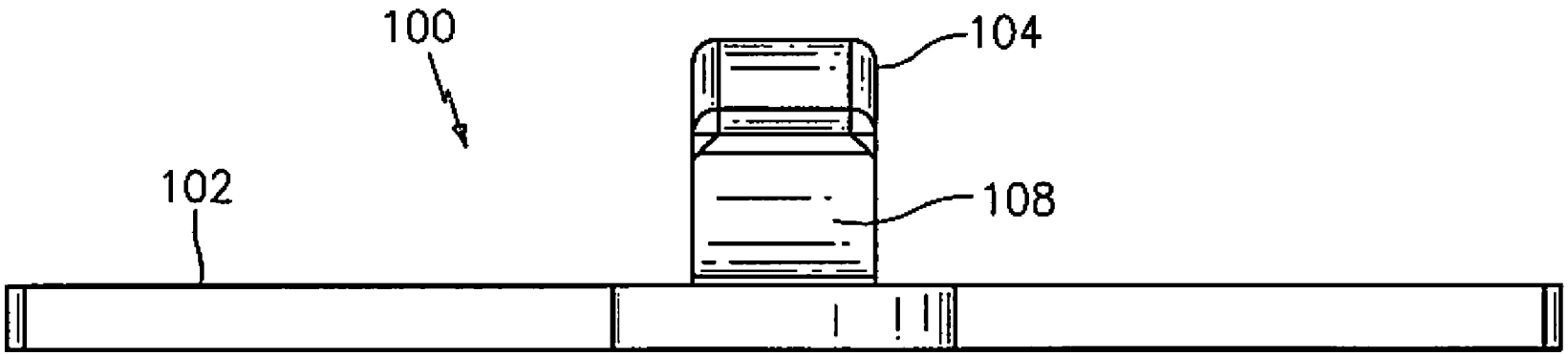
FIG. 3 is a diagram illustrating a front view of a necktie knot tying apparatus, according to an embodiment of the present invention.
Figure 4:
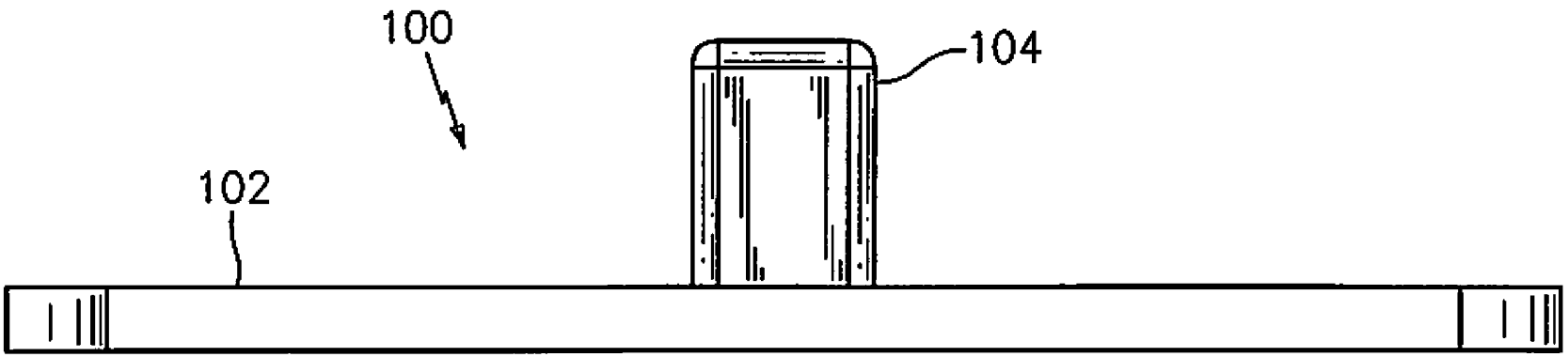
FIG. 4 is a diagram illustrating a back view of a necktie knot tying apparatus, according to an embodiment of the present invention.
Figure 5:
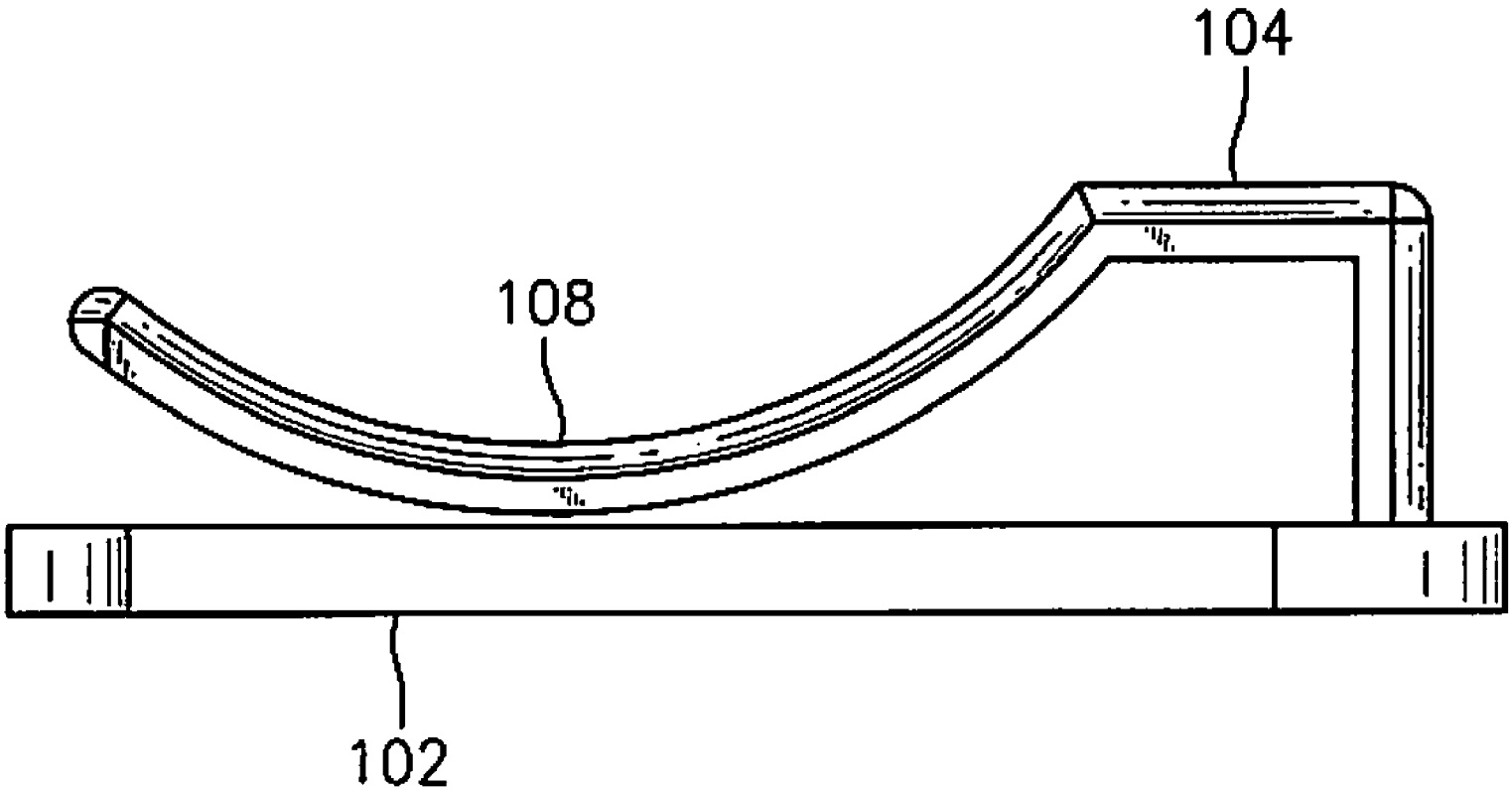
FIG. 5 is a diagram illustrating a side view of a necktie knot tying apparatus, according to an embodiment of the present invention.
Figure 6:
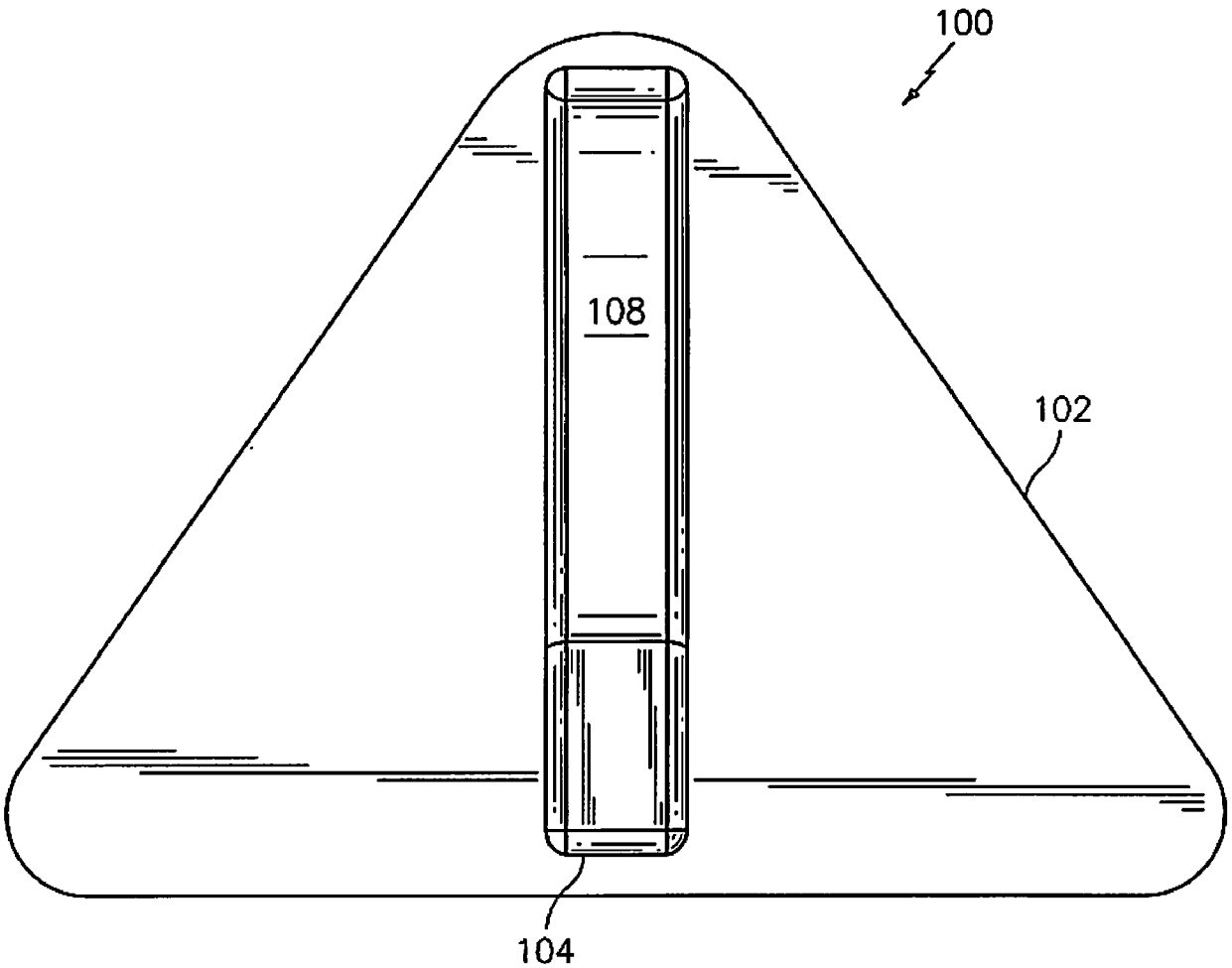
FIG. 6 is a diagram illustrating a top view of a necktie knot tying apparatus, according to an embodiment of the present invention.
Figure 7:
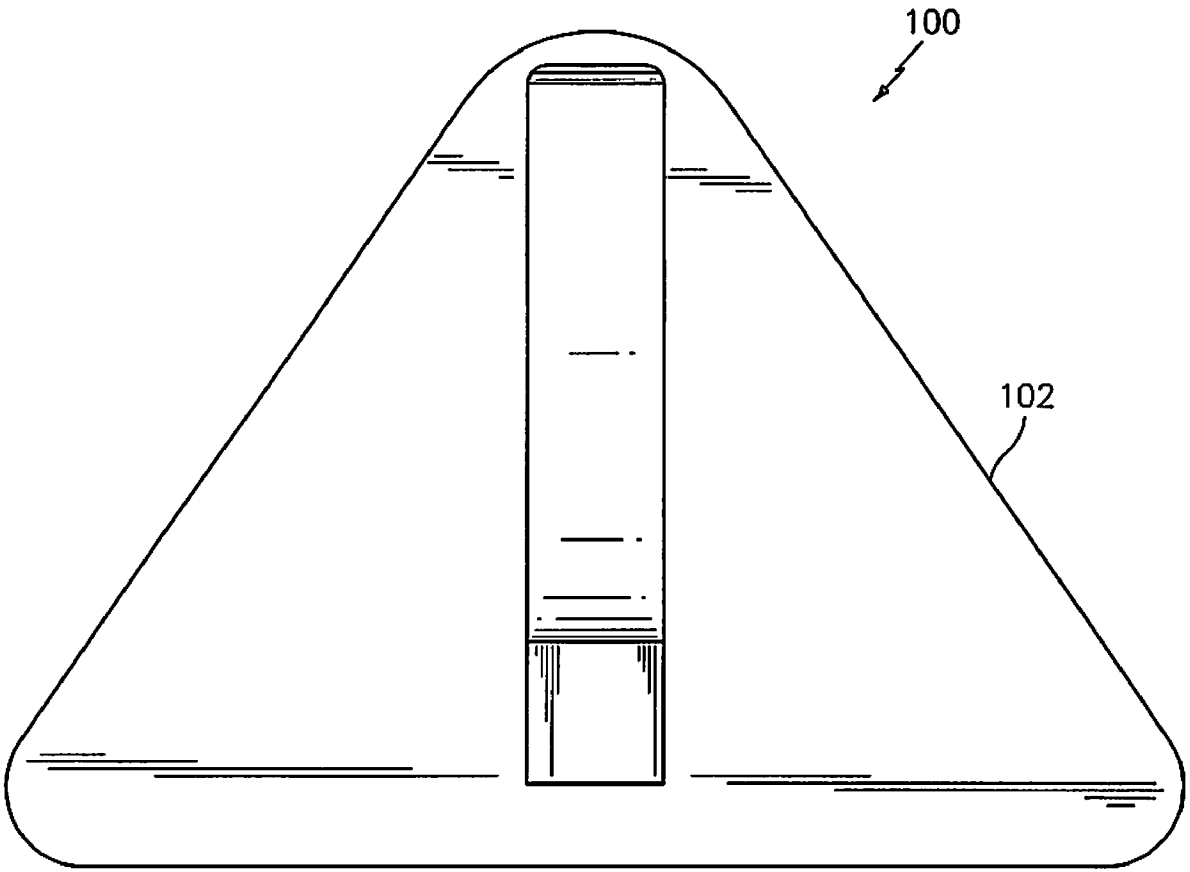
FIG. 7 is a diagram illustrating a bottom view of a necktie knot tying apparatus, according to an embodiment of the present invention.

Referring initially to FIG. 1, a diagram illustrates a top perspective view of a necktie knot tying apparatus, according to an embodiment of the present invention. Necktie knot tying apparatus 100 is used to assist in the formation of a Windsor knot. The apparatus 100 includes a substantially triangular base 102 and an integrated clip 104. In the embodiment of the present invention shown in FIG. 1, the substantially triangular base 102 is shown with a central rectangular aperture 106. Alternative embodiments of the present invention may include one or more apertures of different shapes and sizes, or may not incorporate an aperture into the design.

The integrated clip 104 extends a first predefined distance substantially perpendicularly outward from the substantially triangular base 102, from an area near an edge and between two corners of the substantially triangular base 102. In a preferred embodiment of the present invention, the integrated clip 104 is disposed midway between two corners of the triangular base 102. As illustrated, after extending away from the substantially triangular base 102, the integrated clip 104 runs substantially parallel with the substantially triangular base 102 for a second predefined distance. A curved segment 108 of the integrated clip 104 returns back toward the surface of the substantially triangular base 102.

In the embodiment of the present invention shown in FIG. 1, the integrated clip 104 runs along the length of the central rectangular aperture 106, and the curved portion extends back toward the central rectangular aperture 106. Whether the integrated clip 104 comes in contact with the substantially triangular base 102 at a lowest point of the curved segment 108 depends upon the size and shape of the aperture 106 and the radius of curvature of the curved segment 108. In the embodiment of the present invention shown in FIG. 1, the lowest point of the curved segment is just above the surface of the substantially triangular base 102 and the aperture 106. After its lowest point, the curved segment 108 returns upwardly away from the substantially triangular base 102.

FIGS. 2-7 illustrate a bottom perspective view, a front view, a back view, a side view, a top view and a bottom view, respectively, of the necktie knot tying apparatus, according to the embodiment of the present invention shown in FIG. 1.

When in use, the apparatus 100 is clipped to the crossed portion of the broad end and the narrow end of the tie. The integrated clip 104 extends behind the crossed portion of the tie proximate to the shirt, while the substantially triangular base 102 is disposed in front of the crossed portion of the tie. The integrated clip 104 is flexible enough to receive and release at least one end of the necktie between the integrated clip 104 and the substantially triangular base 102. Preferably, the integrated clip is flexible enough to receive and release a crossed portion of a necktie when necessary, and also is rigid enough that the crossed portion of the necktie is retained between the integrated clip 104 and the substantially triangular base 102. The amount of resistance provided by the integrated clip 104 on the tie is a direct result of the flexibility of the integrated clip 104, the proximity of the curved segment's 108 lowest point to the surface of the substantially triangular base 102, and the size, shape and position of the aperture 106. For example, the lowest point of the curved segment 108 may actually partially extend into the aperture 108 causing increased resistance of the crossed tie between the integrated clip 104 and the substantially triangular base 102.

The corners and/or sides of the surface of the substantially triangular base 102 may be labeled with numbers or letters. Separate instructions may be provided with respect to these labels in order to assist the user of the apparatus 100 in forming a Windsor knot. At least a portion of these instructions may also be incorporated onto the surface of the apparatus 100. The traditional steps for tying a Windsor knot are then followed, wrapping the apparatus 100 within the knot. The apparatus 100 is encased within the knot while the tie is worn, maintaining a structure of the knot that reflects the shape of the substantially triangular base 102, while also hiding the apparatus 100 within the knot. The apparatus also enables easy formation and placement of a dimple in the tie below the knot. The apparatus 100 is easily removed as the knot is untied.

In the embodiment of the present invention shown in FIGS. 1-7, the substantially triangular base 102 is illustrated as an equilateral triangle with rounded corners. In alternative embodiments of the present invention, the shape and/or dimensions of the triangle may be changed, resulting in differently shaped/sized knots. For example, the substantially triangular base 102 may be an isosceles triangle with two longer sides and one shorter side. Alternative embodiments of the present invention may incorporate rounded corners with varying radii of curvature, or one or more non-rounded corners. Further, one or more sides of the substantially triangular base 102 may be curved inwardly toward the center of the triangle in order to form a similarly shaped knot. For example, two sides of the substantially triangular base 102 may be curved inwardly so that the sides of a knot that is formed with the apparatus are also curved inwardly.

The actual shape of the integrated clip 104 may vary in alternative embodiments as long as it extends away from the surface of the substantially triangular base 102, and then returns to an area near or at the surface of the substantially triangular base 102, and is capable of holding at least one end of the tie. Additionally, the length of the integrated clip 104 in comparison with the dimensions of the substantially triangular base 102 may be varied. The apparatus may be constructed of a plastic or a metal, or any material that would maintain the proper structure of the knot while also allowing the integrated clip 104 to flexibly receive and release the crossed portion of the tie.

While the invention has been shown and described with reference to a certain preferred embodiment thereof, it will be understood by those skilled in the art that various changes in form and details may be made therein without departing from the spirit and scope of the invention.

What is claimed is:

1. A necktie knot tying apparatus comprising:

a substantially triangular base having a front face, a back face, three edges and three corners; and an integrated clip extending from an area of the back face of the substantially triangular base that is proximate to one of the three edges and approximately midway between a first of the three corners and a second of the three corners, wherein the integrated clip extends across the back face of the substantially triangular base in a direction of and approximately reaching a third of the three corners;

wherein the integrated clip has a flexibility that enables reception of at least one end of a necktie between the integrated clip and the substantially triangular base, and a rigidity that enables retention of the at least one end between the integrated clip and the substantially triangular base; and wherein the substantially triangular base maintains a substantially triangular structure of a necktie knot that is tied around and encases the substantially triangular base and the integrated clip, wherein the integrated clip comprises a first straight segment, a second straight segment and a third curved segment, the first straight segment extending a first predefined distance substantially perpendicularly outward from the back face of the substantially triangular base, the second straight segment extending from an end of the first segment substantially parallel with the back face of the substantially triangular base for a second predefined distance, and the third curved segment extending from an end of the second straight segment and returning toward the back face of the substantially triangular base.

2. The necktie knot tying apparatus of claim 1, wherein the integrated clip has a flexibility that enables reception of a crossed portion of two ends of the necktie between the integrated clip and the substantially triangular base, and a rigidity that enables retention of the crossed portion of the two ends of the necktie between the integrated clip and the substantially triangular base.

3. The necktie knot tying apparatus of claim 1, wherein the flexibility and the rigidity of the integrated clip is determined by dimensions, thickness and material of the integrated clip.

4. The necktie knot tying apparatus of claim 1, wherein integrated clip contacts the back face of the substantially triangular base at a lowest point of the third curved segment in accordance with a first predefined distance of the first straight segment and a radius of curvature of the third curved segment.

5. The necktie knot tying apparatus of claim 1, wherein, after a lowest point of the third curved segment, the third curved segment returns outwardly away from the back face of the substantially triangular base.

6. The necktie knot tying apparatus of claim 1, wherein the substantially triangular base comprises an aperture.

7. The necktie knot tying apparatus of claim 6, wherein the aperture is substantially rectangular.

8. The necktie knot tying apparatus of claim 6, wherein the aperture is disposed on the substantially triangular base below a portion of a length of the integrated clip.

9. The necktie knot tying apparatus of claim 8, wherein a lowest point of the third curved segment is disposed within the aperture of the substantially triangular base, increasing the retention provided by the integrated clip.

10. The necktie knot tying apparatus of claim 1, wherein the substantially triangular base and the integrated clip enable formation and placement of a dimple in a portion of the necktie extending from below the knot.

11. The necktie knot tying apparatus of claim 1, wherein the substantially triangular base has rounded corners.

12. A method of tying a necktie with a necktie tying apparatus comprising the steps of:

clipping the necktie tying apparatus to a crossed portion of two ends of the necktie between an integrated clip and a substantially triangular base of the necktie tying apparatus, wherein the integrated clip of the necktie tying apparatus extends behind the crossed portion of the necktie proximate to a shirt, and the substantially triangular base is disposed in front of the crossed portion of the necktie, and wherein the integrated clip has a flexibility that enables reception of the crossed portion of the necktie between the integrated clip and the substantially triangular base, and a rigidity that enables retention of the crossed portion of the necktie between the integrated clip and the substantially triangular base; and tying a necktie knot around the necktie tying apparatus, wherein the substantially triangular base maintains a substantially triangular structure of the necktie knot that is tied around and encases the substantially triangular base and the integrated clip.

* * * * *